US010199747B2

(12) United States Patent
Lin et al.

(10) Patent No.: US 10,199,747 B2
(45) Date of Patent: Feb. 5, 2019

(54) ANTENNA AND ANTENNA ARRAY

(71) Applicant: NANNING FUGUI PRECISION INDUSTRIAL CO., LTD., Nanning (CN)

(72) Inventors: Tsung-Ching Lin, New Taipei (TW); Liang-Hsien Hung, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 15/665,329

(22) Filed: Jul. 31, 2017

(65) Prior Publication Data

US 2019/0006771 A1 Jan. 3, 2019

(30) Foreign Application Priority Data

Jun. 30, 2017 (CN) ..... 2017 1 0522045

(51) Int. Cl.

| | |
|---|---|
| ***H01Q 25/00*** | (2006.01) |
| ***H01Q 1/48*** | (2006.01) |
| ***H01Q 21/00*** | (2006.01) |
| ***H01Q 9/04*** | (2006.01) |

(52) U.S. Cl.

CPC ..... *H01Q 25/00* (2013.01); *H01Q 1/48* (2013.01); *H01Q 9/0407* (2013.01); *H01Q 9/0435* (2013.01); *H01Q 21/0025* (2013.01)

(58) Field of Classification Search

CPC .... H01Q 9/0435; H01Q 9/0407; H01Q 25/00; H01Q 21/0025; H01Q 1/38

See application file for complete search history.

(56) References Cited

U.S. PATENT DOCUMENTS

| | | | | |
|---|---|---|---|---|
| 5,515,057 | A | 5/1996 | Lennen et al. | |
| 6,133,882 | A | 10/2000 | LaFleur et al. | |
| 2006/0214853 | A1* | 9/2006 | Hori | H01Q 9/0407 343/700 MS |
| 2012/0032869 | A1* | 2/2012 | Hawkins | H01Q 9/045 343/857 |

(Continued)

FOREIGN PATENT DOCUMENTS

| | | | |
|---|---|---|---|
| CN | 101557037 | A | 10/2009 |
| CN | 101662070 | A | 3/2010 |

(Continued)

*Primary Examiner* — Hoang Nguyen

(74) *Attorney, Agent, or Firm* — ScienBiziP, P.C.

(57) ABSTRACT

An antenna includes a radiator, a first feeding portion, a second feeding portion, a first grounding portion, a second grounding portion, and a loading portion. The radiator is parallel to the base board to radiate signals. A first end of the first feeding portion is electrically coupled to a central position of the radiator. A second end of the first feeding portion receives a first feeding signal to generate a first radiation pattern. A first end of the second feeding portion is electrically coupled to a first corner of the radiator. A second end of the second feeding portion receives a second signal to generate a second radiation pattern. The first grounding portion is electrically coupled between a second corner of the radiator and a ground plane of the base board. The second grounding portion is electrically coupled between a third corner of the radiator and the ground plane.

18 Claims, 20 Drawing Sheets

(56) References Cited

U.S. PATENT DOCUMENTS

| | | | |
|---|---|---|---|
| 2012/0200462 | A1 | 8/2012 | Rao et al. |
| 2017/0062933 | A1 | 3/2017 | Wu et al. |

FOREIGN PATENT DOCUMENTS

| | | | | |
|---|---|---|---|---|
| CN | 204156092 | U | 2/2015 | |
| EP | 2913893 | | 9/2015 | |
| JP | WO 2009031386 | A1 * | 3/2009 | ..... G06K 19/07786 |

* cited by examiner

ANTENNA AND ANTENNA ARRAY

FIELD

The subject matter herein generally relates to wireless communication field, particularly relates to an antenna and an antenna array.

BACKGROUND

A multi-antenna communication system is becoming popular. However, a multi-antenna communication system faces many challenges. For example, in a multi-antenna communication system, as the quantity of antennas increases, interferences between antennas become more serious. Moreover, a general antenna only provides one radiation pattern. If more radiation patterns are necessary, more antennas are necessary in a communication system. But a communication system only has a limited amount of space. Building more antennas in the communication system is becoming more difficult. In addition, the range of a half-power angle in a general antenna is small. Improvement in the art is preferred.

BRIEF DESCRIPTION OF THE DRAWING

Implementations of the present disclosure will now be described, by way of example only, with reference to the attached figures, wherein.

DETAILED DESCRIPTION

Figure 1:
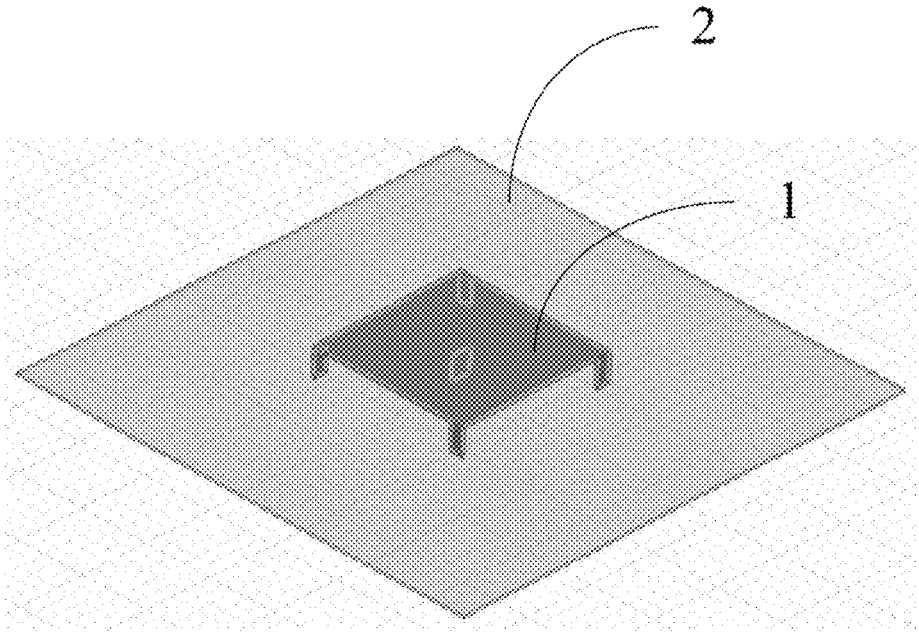
FIG. 1 is a diagram illustrating an exemplary embodiment of an antenna.

It will be appreciated that for simplicity and clarity of illustration, where appropriate, reference numerals have been repeated among the different figures to indicate corresponding or analogous elements. In addition, numerous specific details are set forth to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale, and the proportions of certain parts have been exaggerated to illustrate details and features of the present disclosure better. The disclosure is illustrated by way of example and not by way of limitation in the figures of the accompanying drawings in which like references indicate similar elements. It should be noted that references to "an" or "one" exemplary embodiment in this disclosure are not necessarily to the same exemplary embodiment, and such references mean at least one.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

Figure 2:
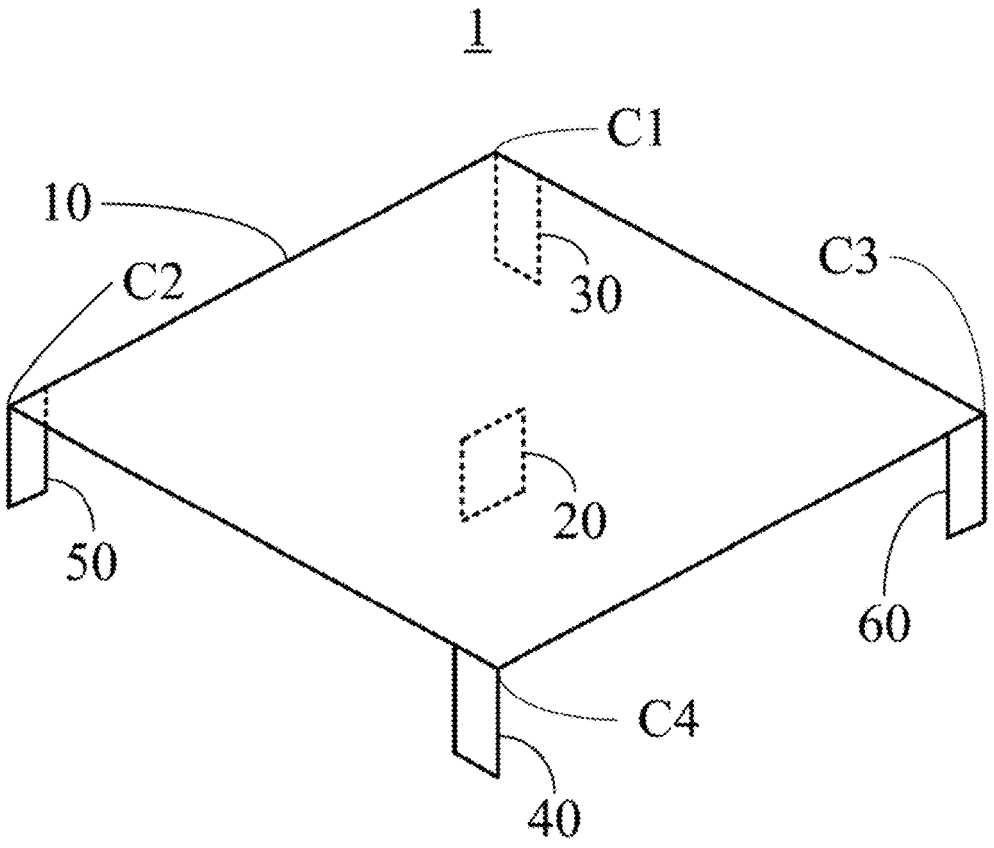
FIG. 2 is a perspective view illustrating a first exemplary embodiment of the antenna.
Figure 3:
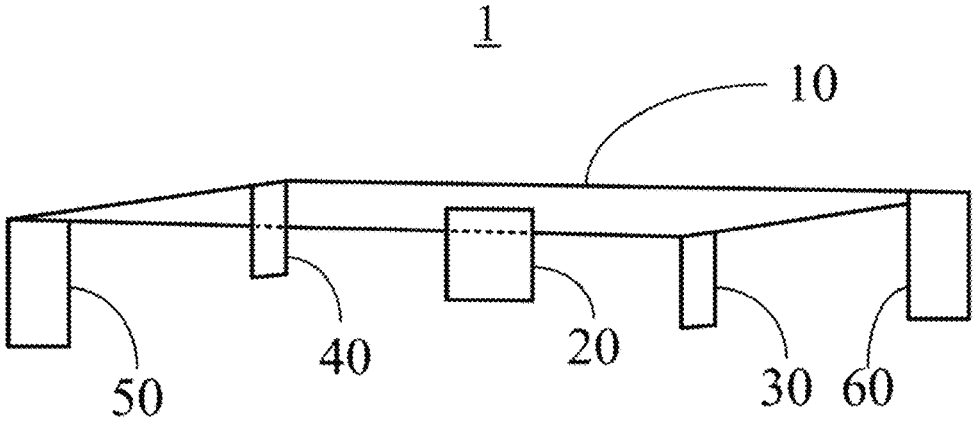
FIG. 3 is another perspective view illustrating the first exemplary embodiment of the antenna.

Referring to FIG. 1 to FIG. 3, FIG. 1 is a diagram illustrating a first exemplary embodiment of an antenna 1, and FIG. 2 and FIG. 3 are both perspective views illustrating the first exemplary embodiment of the antenna 1. The different is that, FIG. 2 is the antenna 1 viewed from the top to the bottom, while FIG. 3 is the antenna 1 viewed from the bottom to the top.

In the first exemplary embodiment, the antenna 1 is electrically coupled to a base board 2. The base board 2 comprises a ground plane (not shown in figures). The ground plane is configured to have signal reflection. The antenna 1 comprises a radiator 10, a first feeding portion 20, a second feeding portion 30, a loading portion 40, a first grounding portion 50 and a second grounding portion 60. A radiating area of the radiator 10 is square shaped. Four corners of the radiating area respectively form a first corner C1 of the radiator 10, a second corner C2 of the radiator 10, a third corner C3 of the radiator 10, and a fourth corner C4 of the radiator 10. In other exemplary embodiment, a radiating area of the radiator 10 can be other shaped, such as quadrangle shaped or polygon shaped.

A plane of the radiator 10 is parallel to a plane of the base board 2. A first end of the first feeding portion 20 is electrically coupled to a central position of the radiator 10. A second end of the first feeding portion 20 is configured to receive a first feeding signal to generate a first radiation pattern. A first end of the second feeding portion 30 is electrically coupled to the first corner C1 of the radiator 10. A second end of the second feeding portion 30 is configured to receive a second signal to generate a second radiation pattern. The first grounding portion 50 is electrically coupled between the second corner C2 of the radiator 10 and the ground plane. The second grounding portion 60 is electrically coupled between the third corner C3 of the radiator 10 and the ground plane. The loading portion 40 is electrically coupled between the fourth corner C4 of the radiator 10 and a load. The loading portion 40 is configured to match impedance. In the exemplary embodiment, a value of the load can be 50 Ohm. A working frequency band of the antenna 1 is from 5150 MHz to 5850 MHz.

The second corner C2 of the radiator 10 and the third corner C3 of the radiator 10 are both aligned in the same diagonal line of the radiator 10. Namely, the first grounding portion 50 and the second grounding portion 60 are respectively in opposite corners of the radiator 10. Moreover, the first feeding portion 20, the second feeding portion 30, the first grounding portion 50, the second grounding portion 60 and the loading portion 40 are strip shaped. The first feeding portion 20, the second feeding portion 30, the first grounding portion 50, the second grounding portion 60 and the loading portion 40 are perpendicular connected to the radiator 10. The first grounding portion 50 is parallel to the second grounding portion 60. The second feeding portion 30 is parallel to the loading portion 40. In the exemplary embodiment, the radiator 10 contacts the base board 2 through the first feeding portion 20, the second feeding portion 30, the first grounding portion 50 and the second grounding portion 60. In other exemplary embodiment, the radiator 10 contacts the base board 2 only through the first grounding portion 50 and the second grounding portion 60. In the exemplary embodiment, the length of the antenna 1 is 23.5 millimeters. The width of the antenna 1 is 23.5 millimeters. The height of the antenna 1 is 4.4 millimeters.

Figure 4:
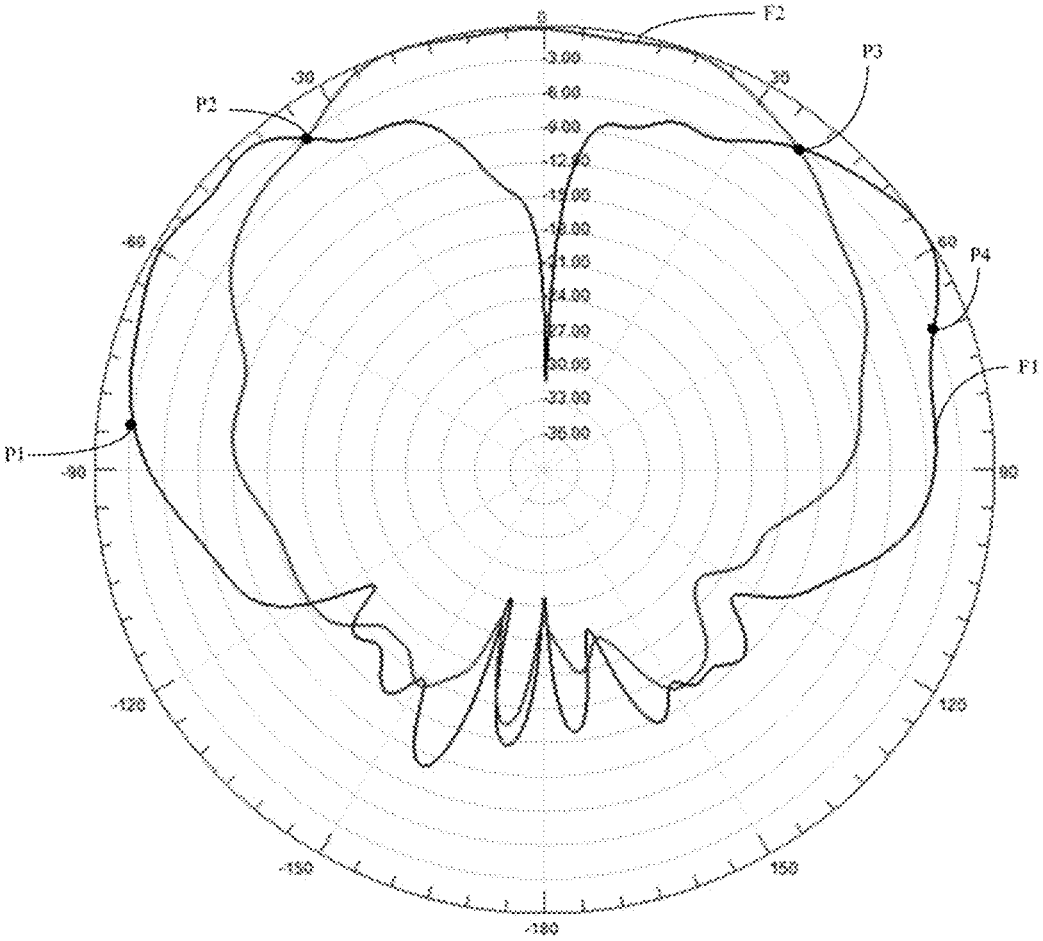
FIG. 4 is a measurement diagram illustrating a two-dimension radiation pattern of the first exemplary embodiment of the antenna.

Referring to FIG. 4, FIG. 4 is a measurement diagram illustrating a two-dimension radiation pattern of the first exemplary embodiment of the antenna 1.

In the exemplary embodiment, the antenna 1 is described by spherical coordinate system. People skilled in the art easily understand that the spherical coordinate system represents a coordinate system of a point in three-dimensional space. Projection of a line between the point and the origin of coordinates in a X-Y plane, and X axis form an angle phi (φ). In the exemplary embodiment, the plane of the base board 2 is the X-Y plane. The direction from the plane of the base board 2 to the radiator 10 is the direction of a positive Z axis. As shown in FIG. 4, the two-dimension radiation pattern of the exemplary embodiment of the antenna 1 is measured under a condition that the angle phi equals to 0 degree.

As shown in FIG. 4, a curve F1 represents the first radiation pattern, a curve F2 represents the second radiation pattern. As people skilled in the art easily understand that a half-power angle represents a beam width when a highest power decreases to 3 dB. According to FIG. 4, the curve F1 intersects a line of 3 dB at a first point P1, a second point P2, a third point P3 and a fourth point P4. The first point P1 locates at a first angle of about −84°. The second point P2 locates at a second angle of about −35°. The third point P3 locates at a third angle of about 38.5°. The fourth point P4 locates at a fourth angle of about 70°. The curve F2 intersects the line of 3 dB at the second point P2 and the third point P3. The half-power angle of the first radiation pattern is a range from the first angle to the second angle and a range from the third angle to the fourth angle. In the exemplary embodiment, the half-power angle of the first radiation pattern is a range from −84° to −35° and a range from 38.5° to 70°. Therefore, the first radiation pattern has a wide signal cover area. The half-power angle of the second radiation pattern is a range from the second angle to the third angle. In the exemplary embodiment, the half-power angle of the second radiation pattern is a range from −35° to 38.5°. Therefore, the second radiation pattern has a directional signal cover area. Viewing cover areas as a whole, the cover area of the first radiation pattern and the cover area of the second radiation pattern form a continuous cover area of a half-power angle. In the exemplary embodiment, the continuous cover area of a half-power angle is from the first angle to the fourth angle. Thus, a half-power angle of the antenna 1 is larger than 150 degrees.

In the exemplary embodiment, when generating the first radiation pattern, the second feeding portion 30 is electrically coupled to a load. When generating the second radiation pattern, the first feeding portion 20 is electrically coupled to a load. When a wide signal cover area is needed, the antenna 1 generates the first radiation pattern. When a directional signal cover area is needed, the antenna 1 generates the second radiation pattern. Comparing to a general antenna in which only has one radiation pattern, the antenna 1 not only radiates signals in a wide signal cover area, but also radiates signals in a directional signal cover area. Thus, the antenna 1 can be applied on a ceiling and also on a wall.

Figure 5:
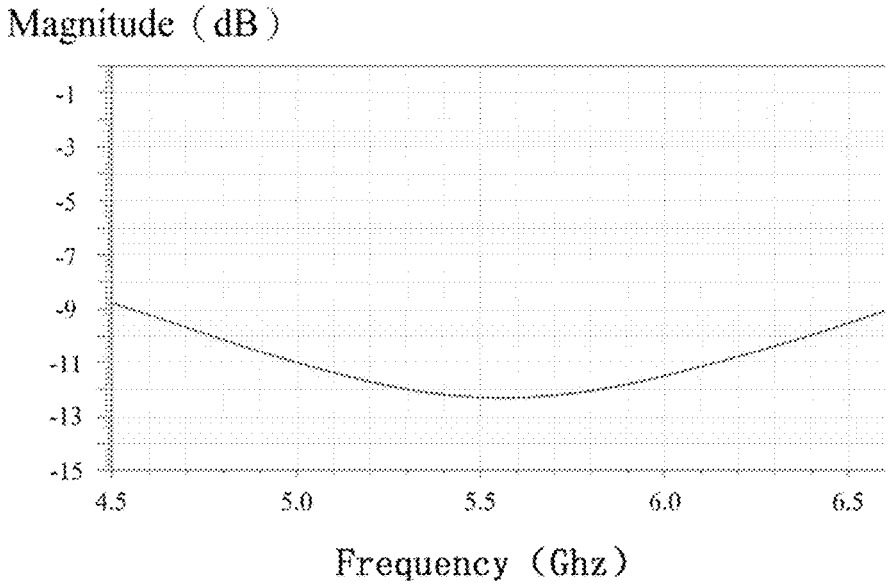
FIG. 5 is a return loss measurement diagram of the first exemplary embodiment of the antenna.
Figure 6:
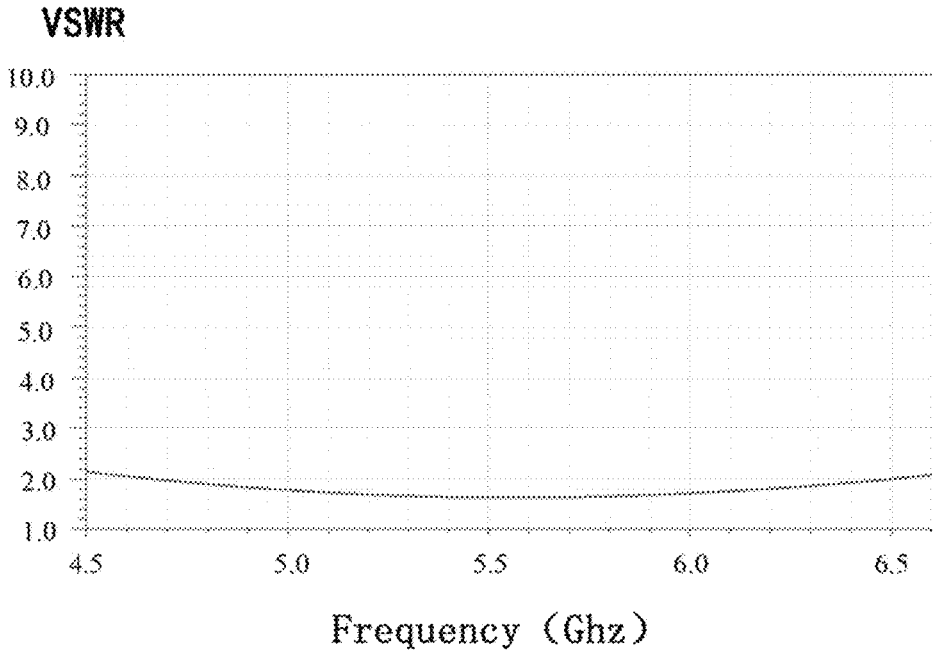
FIG. 6 is a VSWR measurement diagram of the first exemplary embodiment of the antenna.

Referring to FIG. 5 and FIG. 6, FIG. 5 is a return loss measurement diagram of first exemplary embodiment of the antenna 1 when generating the first radiation pattern, and FIG. 6 is a VSWR measurement diagram of an exemplary embodiment of an antenna 1 when generating the first radiation pattern. As shown in FIG. 5 and FIG. 6, a return loss value is less than −8 dB when generating the first radiation pattern. At the same time, a value of VSWR (Voltage Standing Wave Ratio) is less than 2.2. Thus, a reflection power is low and the transmission efficiency is high.

Figure 7:
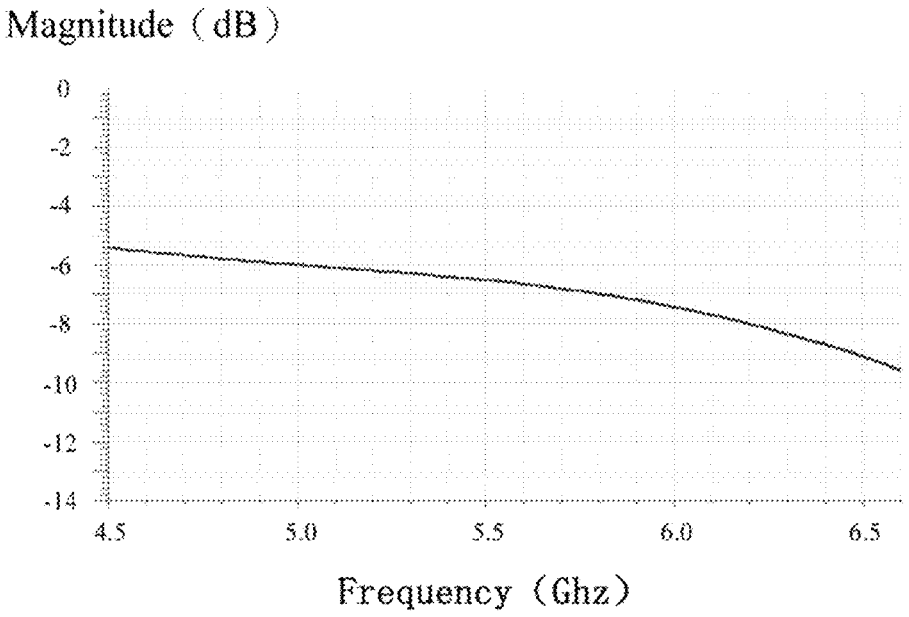
FIG. 7 is a return loss measurement diagram of the first exemplary embodiment of the antenna.
Figure 8:
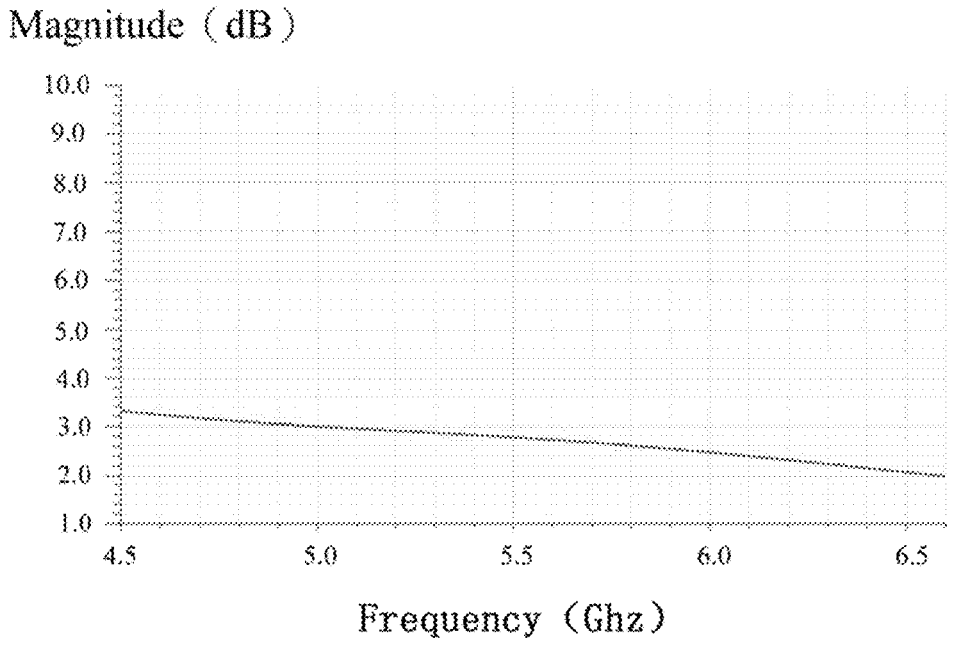
FIG. 8 is a VSWR measurement diagram of the first exemplary embodiment of the antenna.

Referring to FIG. 7 and FIG. 8, FIG. 7 is a return loss measurement diagram of the first exemplary embodiment of the antenna 1 when generating the second radiation pattern, and FIG. 8 is a VSWR measurement diagram of the first exemplary embodiment of the antenna when generating the second radiation pattern. As shown in FIG. 7 and FIG. 8, a return loss value is less than −5 dB when generating the second radiation pattern. At the same time, a value of VSWR (Voltage Standing Wave Ratio) is less than 3.3. Thus, a reflection power is low and the transmission efficiency is high.

Figure 9:
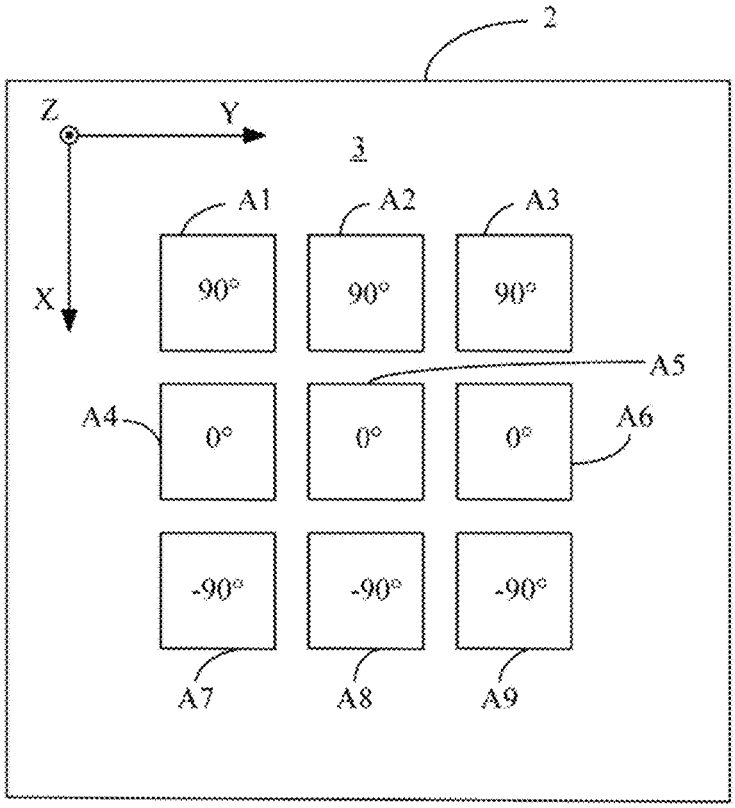
FIG. 9 is a diagram illustrating a first exemplary embodiment of an antenna array.
Figure 10:
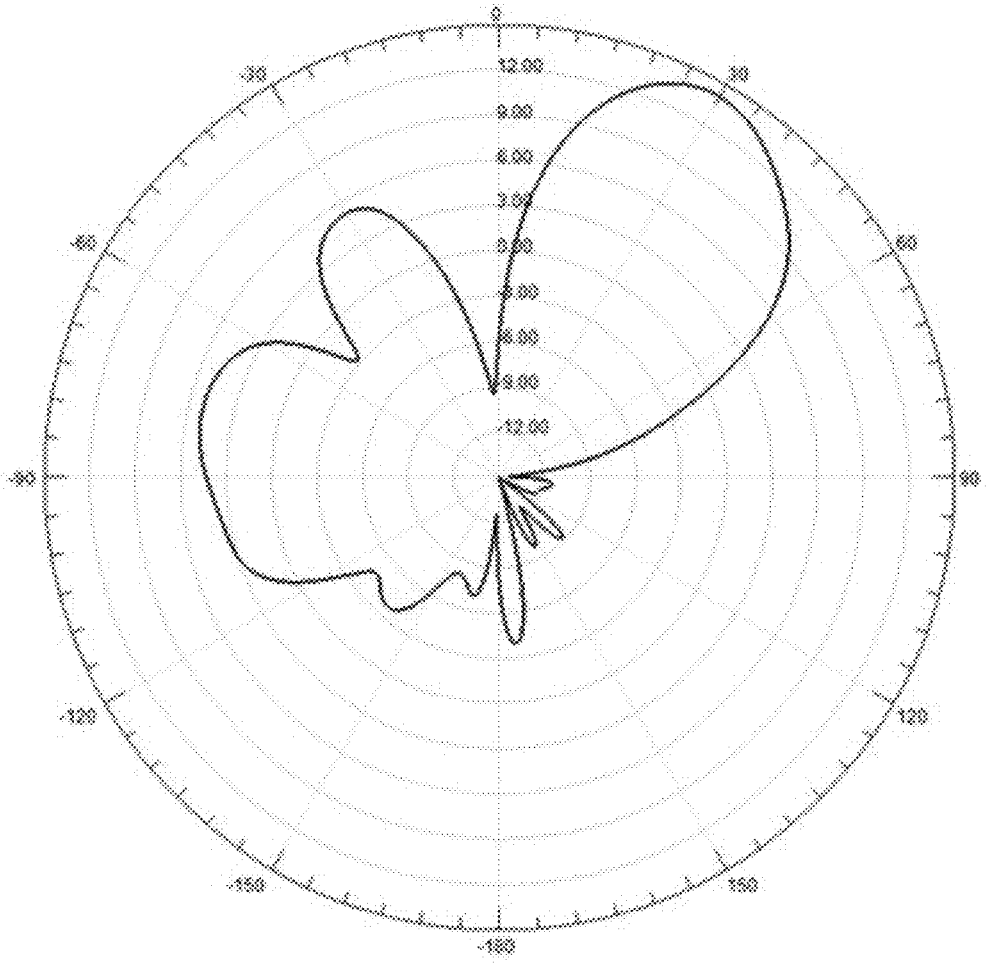
FIG. 10 is a measurement diagram illustrating a radiation pattern of X-Z plane of the first exemplary embodiment of the antenna array.
Figure 11:
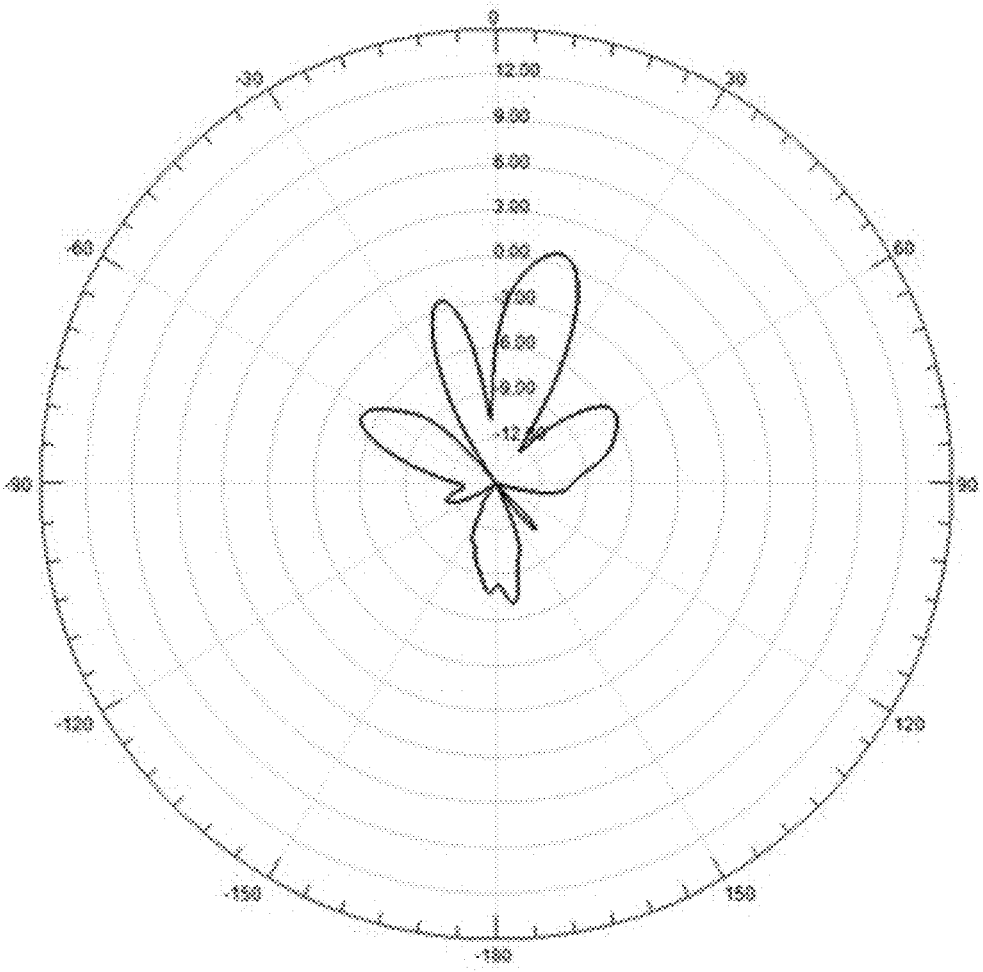
FIG. 11 is a measurement diagram illustrating a radiation pattern of Y-Z plane of the first exemplary embodiment of the antenna array.

Referring to FIGS. 9-11, FIG. 9 is a diagram illustrating the first exemplary embodiment of an antenna array 3, FIG. 10 is a measurement diagram illustrating a radiation pattern of X-Z plane of the first exemplary embodiment of the antenna array 3, and FIG. 11 is a measurement diagram illustrating a radiation pattern of Y-Z plane of the first exemplary embodiment of the antenna array 3. In the exemplary embodiment, the plane of the base board 2 is the X-Y plane. The direction from the plane of the base board 2 to the radiator 10 is the direction of a positive Z axis. As shown in FIG. 9, the antenna array 3 comprises nine antennas A1-A9. All of the antennas A1-A9 have the same structure of above antenna 1. The antennas A1-A9 are arranged in a form of 3×3 array. In the exemplary embodiment. Each radiator of the antennas A1-A9 is parallel to the base board 2. Antennas A1-A3 are placed in a first row. Antennas A4-A6 are placed in a second row. Antenna A7-A9 are placed in a third row. The antennas A1-A3 respectively receive signals in which phases are advanced 90 degrees. The antennas A4-A6 respectively receive signals in which phases are 0 degree. The antennas A7-A9 respectively receive signals in which phases are delayed 90 degrees. Thus, beam forming of the antenna array 3 can be controlled. According to FIGS. 10-11, powers of beam forming are mainly directed to the positive X axis. Namely, powers of beam forming are mainly directed to a direction in which angle phi equals to 0 degree.

Figure 12:
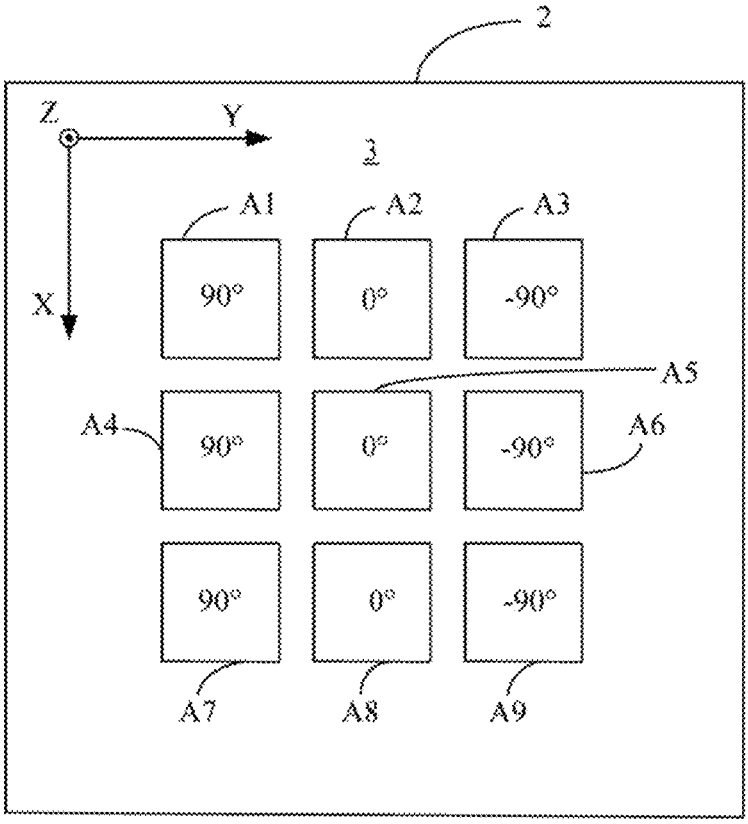
FIG. 12 is a diagram illustrating a second exemplary embodiment of the antenna array.
Figure 13:
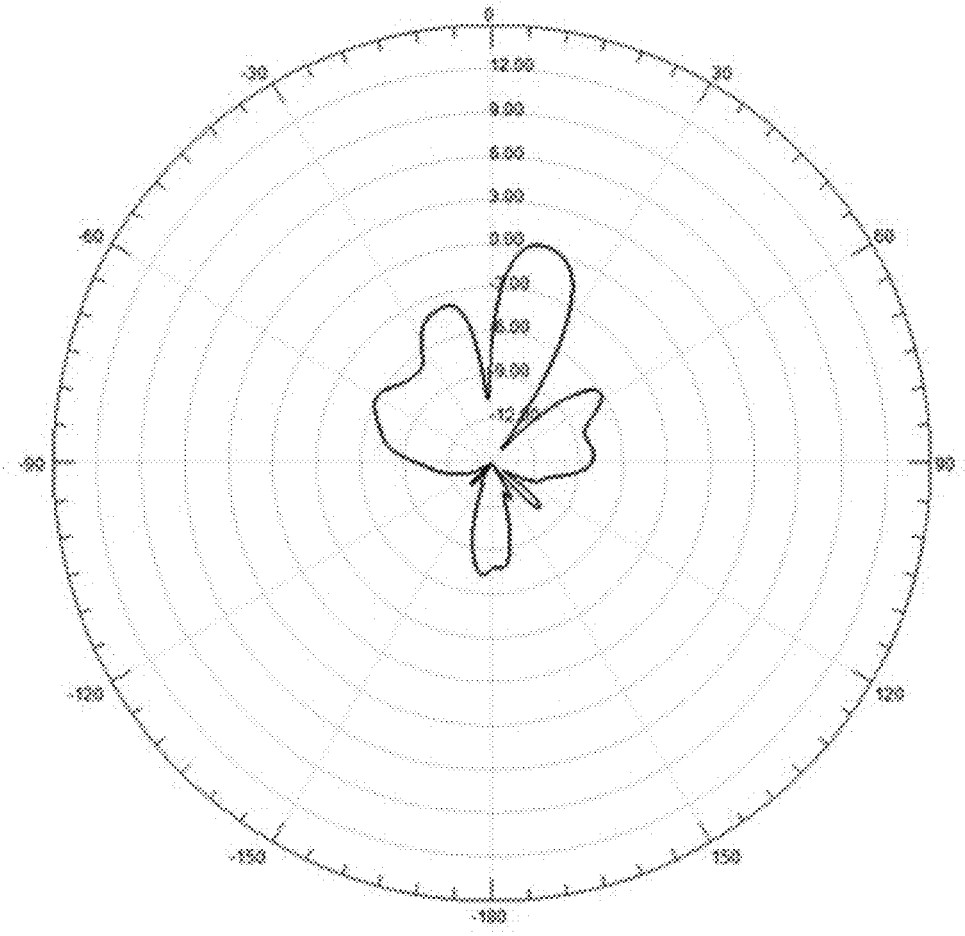
FIG. 13 is a measurement diagram illustrating a radiation pattern of X-Z plane of the second exemplary embodiment of the antenna array.
Figure 14:
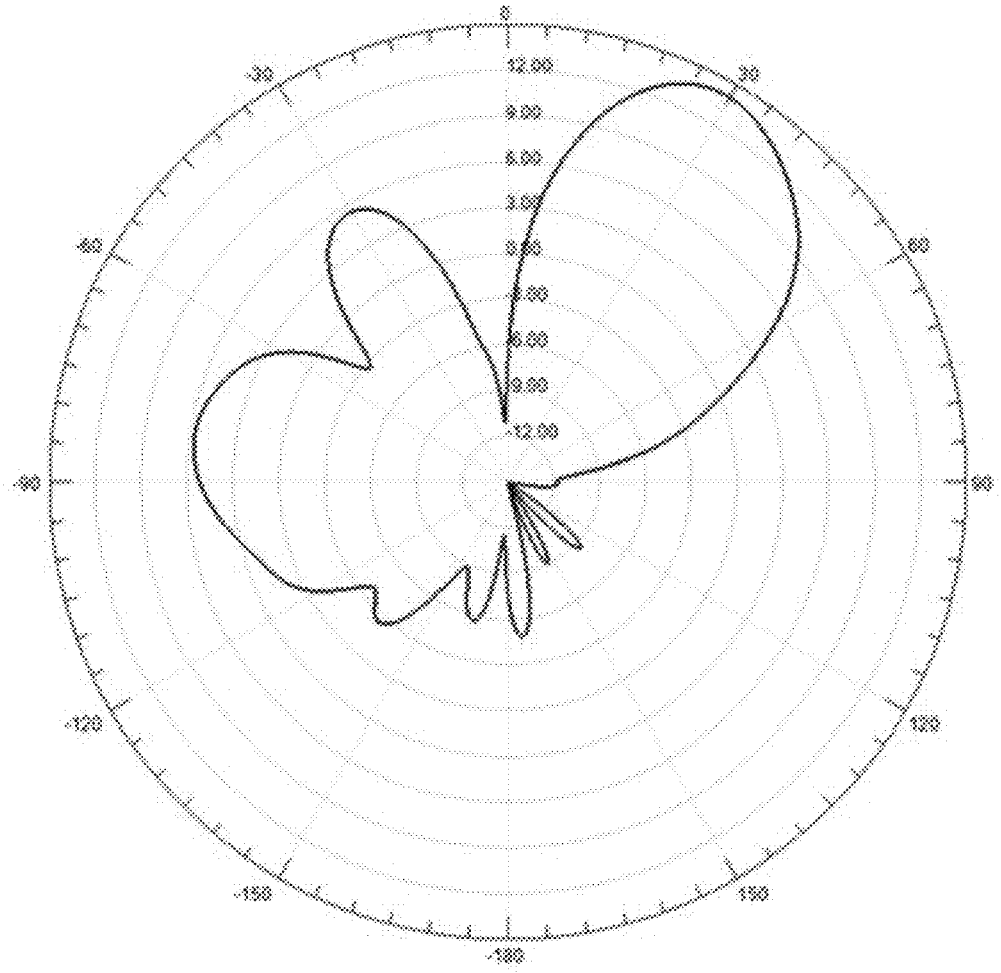
FIG. 14 is a measurement diagram illustrating a radiation pattern of Y-Z plane of the second exemplary embodiment of the antenna array.

Referring to FIGS. 12-14, FIG. 12 is a diagram illustrating a second exemplary embodiment of the antenna array 3. FIG. 13 is a measurement diagram illustrating a radiation pattern of X-Z plane of the second exemplary embodiment of an antenna array 3. FIG. 14 is a measurement diagram illustrating a radiation pattern of Y-Z plane of the second exemplary embodiment of an antenna array 3. In the exemplary embodiment, the plane of the base board 2 is the X-Y plane. The direction from the plane of the base board 2 to the radiator 10 is the direction of a positive Z axis. As shown in FIG. 12, the antenna array 3 also comprises nine antennas A1-A9. All of the antennas A1-A9 have the same structure of above antenna 1. The antennas A1-A9 are arranged in a form of 3×3 array. In the exemplary embodiment. Each radiator of the antennas A1-A9 is parallel to the base board 2. Antennas A1-A3 are placed in a first row. Antennas A4-A6 are placed in a second row. Antenna A7-A9 are placed in a third row. The antennas A1, A4, A7 respectively receive signals in which phases are advanced 90 degrees. The antennas A2, A5, A8 respectively receive signals in which phases are 0 degree. The antennas A3, A6, A9 respectively receive signals in which phases are delayed 90 degrees. Thus, beam forming of the antenna array 3 can be controlled. According to FIG. 13 and FIG. 14, powers of beam forming are mainly directed to the positive Y axis. Namely, powers of beam forming are mainly directed to a direction in which angle phi equals to 90 degrees.

Figure 15:
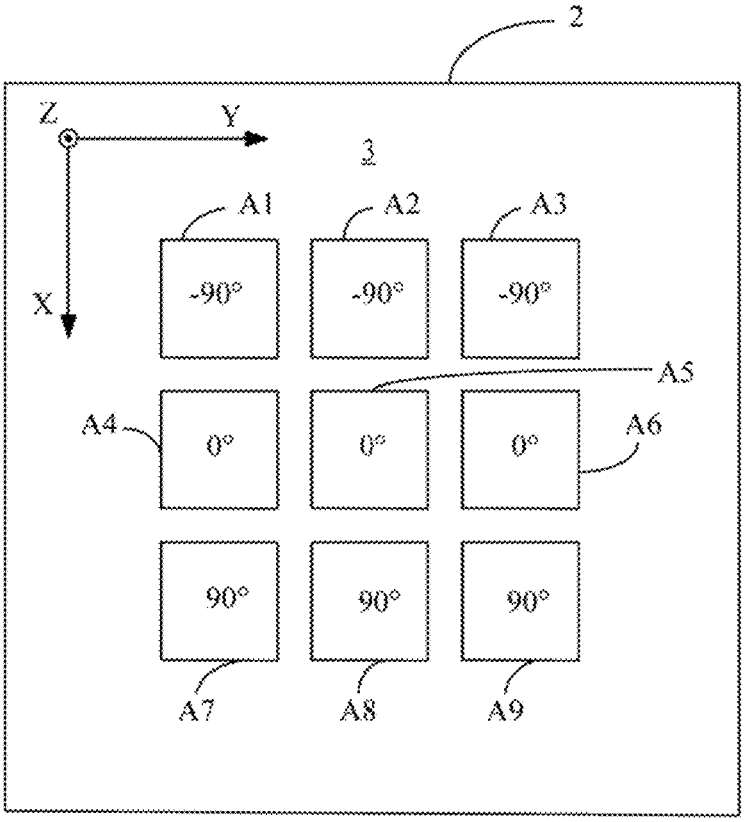
FIG. 15 is a diagram illustrating a third exemplary embodiment of the antenna array.
Figure 16:
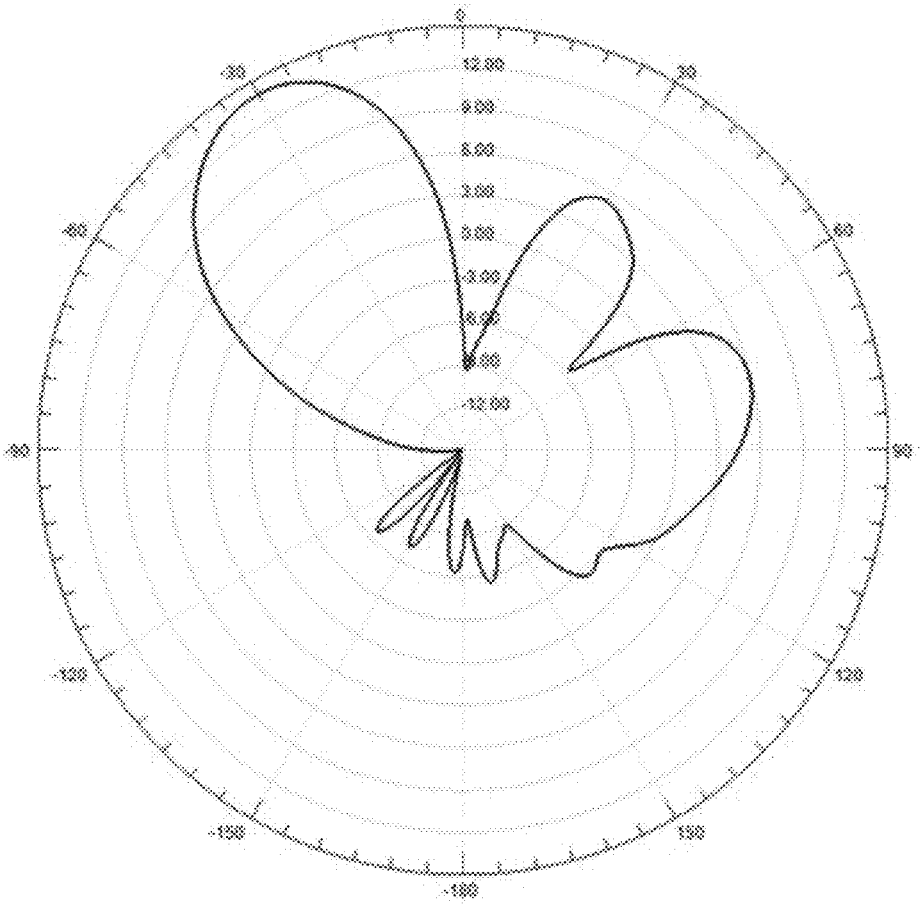
FIG. 16 is a measurement diagram illustrating a radiation pattern of X-Z plane of the third exemplary embodiment of the antenna array.
Figure 17:
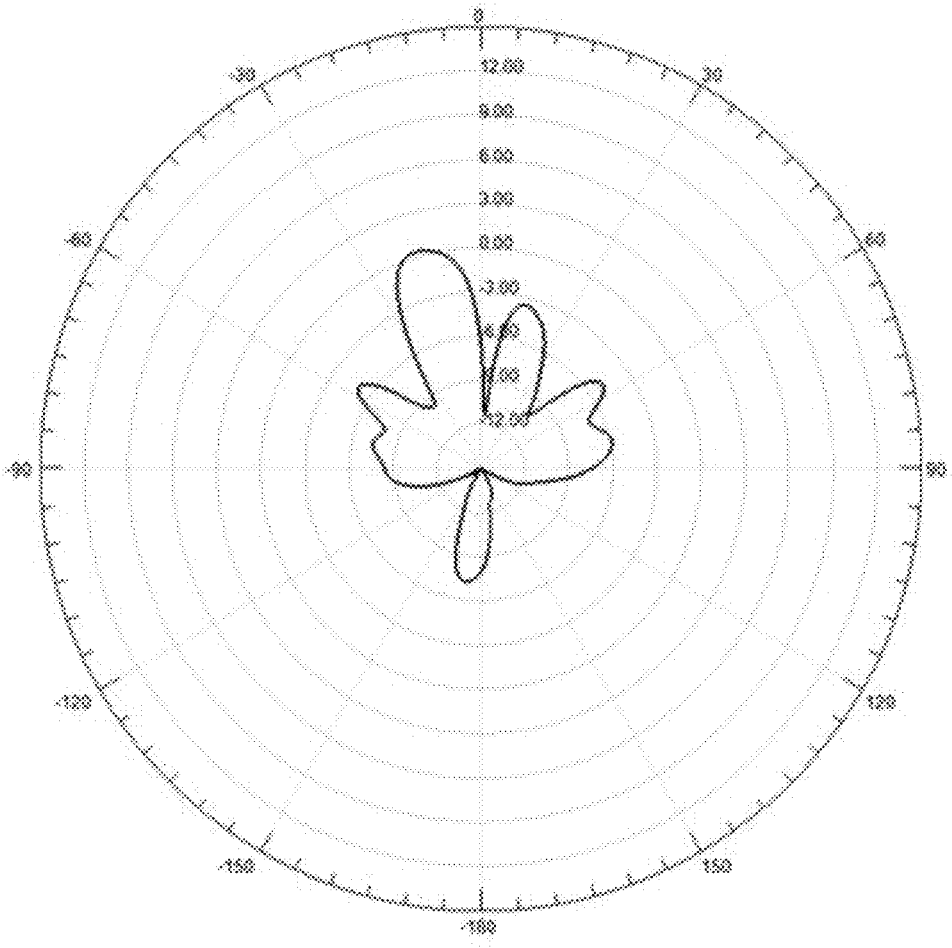
FIG. 17 is a measurement diagram illustrating a radiation pattern of Y-Z plane of the third exemplary embodiment of the antenna array.

Referring to FIGS. 15-17, FIG. 15 is a diagram illustrating a third exemplary embodiment of an antenna array 3. FIG. 16 is a measurement diagram illustrating a radiation pattern of X-Z plane of the third exemplary embodiment of the antenna array 3. FIG. 17 is a measurement diagram illustrating a radiation pattern of Y-Z plane of the third exemplary embodiment of the antenna array 3. In the exemplary embodiment, the plane of the base board 2 is the X-Y plane. The direction from the plane of the base board 2 to the radiator 10 is the direction of a positive Z axis. As shown in FIG. 15, the antenna array 3 also comprises nine antennas A1-A9. All of the antennas A1-A9 have the same structure of above antenna 1. The antennas A1-A9 are arranged in a form of 3×3 array. In the exemplary embodiment. Each radiator of the antennas A1-A9 is parallel to the base board 2. Antennas A1-A3 are placed in a first row. Antennas A4-A6 are placed in a second row. Antenna A7-A9 are placed in a third row. The antennas A1-A3 respectively receive signals in which phases are delayed 90 degrees. The antennas A4-A6 respectively receive signals in which phases are 0 degree. The antennas A7-A9 respectively receive signals in which phases are advanced 90 degrees. Thus, beam forming of the antenna array 3 can be controlled. According to FIG. 16 and FIG. 17, powers of beam forming are mainly directed to the negative X axis. Namely, powers of beam forming are mainly directed to a direction in which angle phi equals to 180 degrees.

Figure 18:
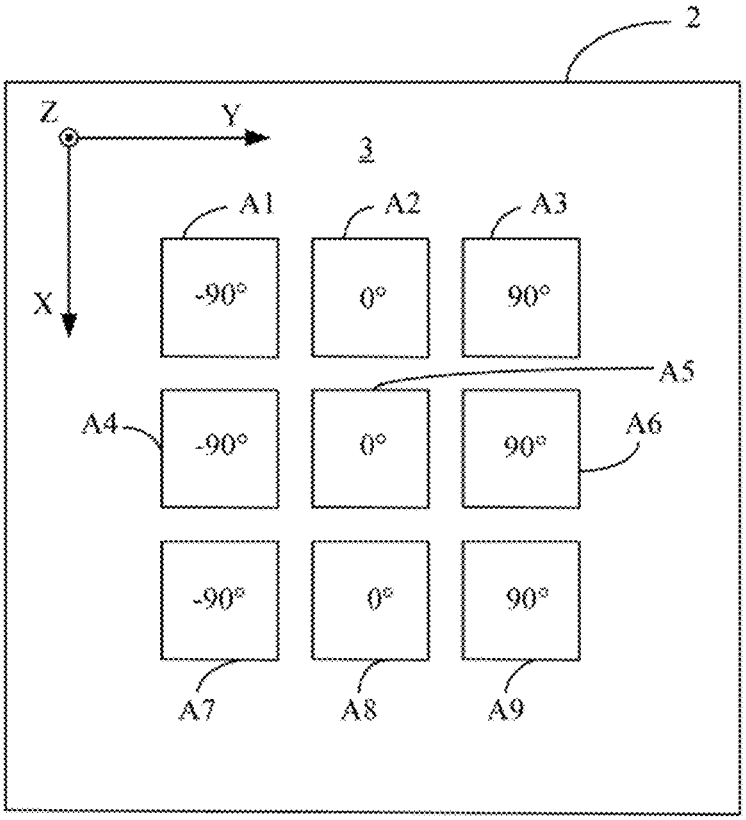
FIG. 18 is a diagram illustrating a fourth exemplary embodiment of the antenna array.
Figure 19:
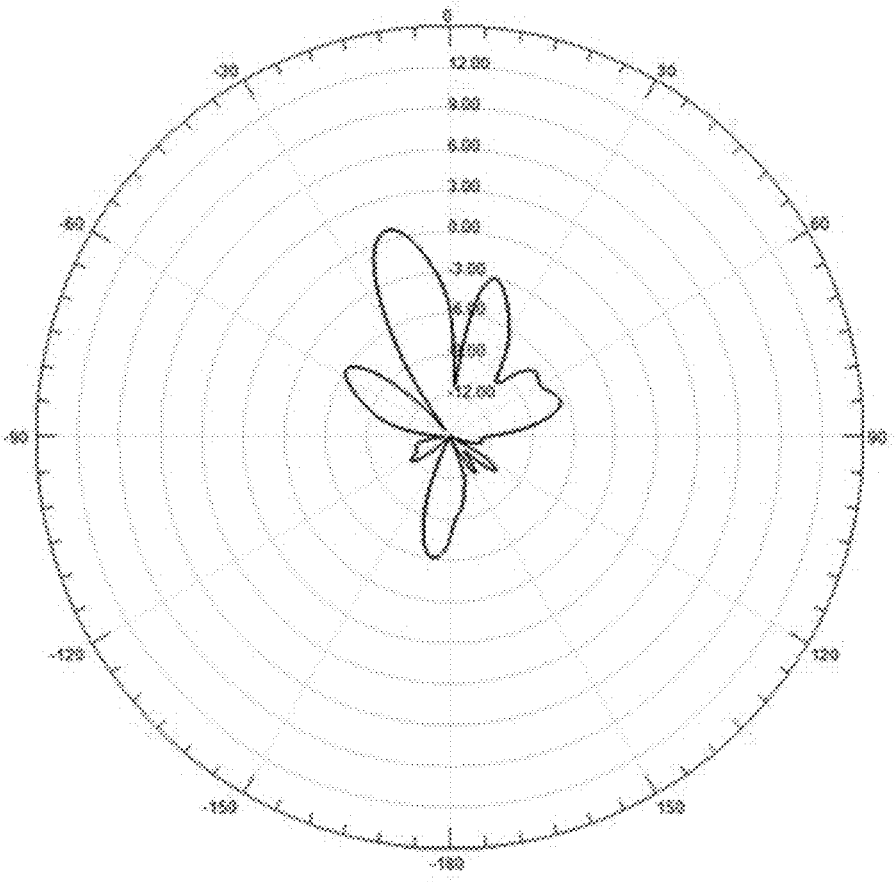
FIG. 19 is a measurement diagram illustrating a radiation pattern of X-Z plane of the fourth exemplary embodiment of the antenna array.
Figure 20:
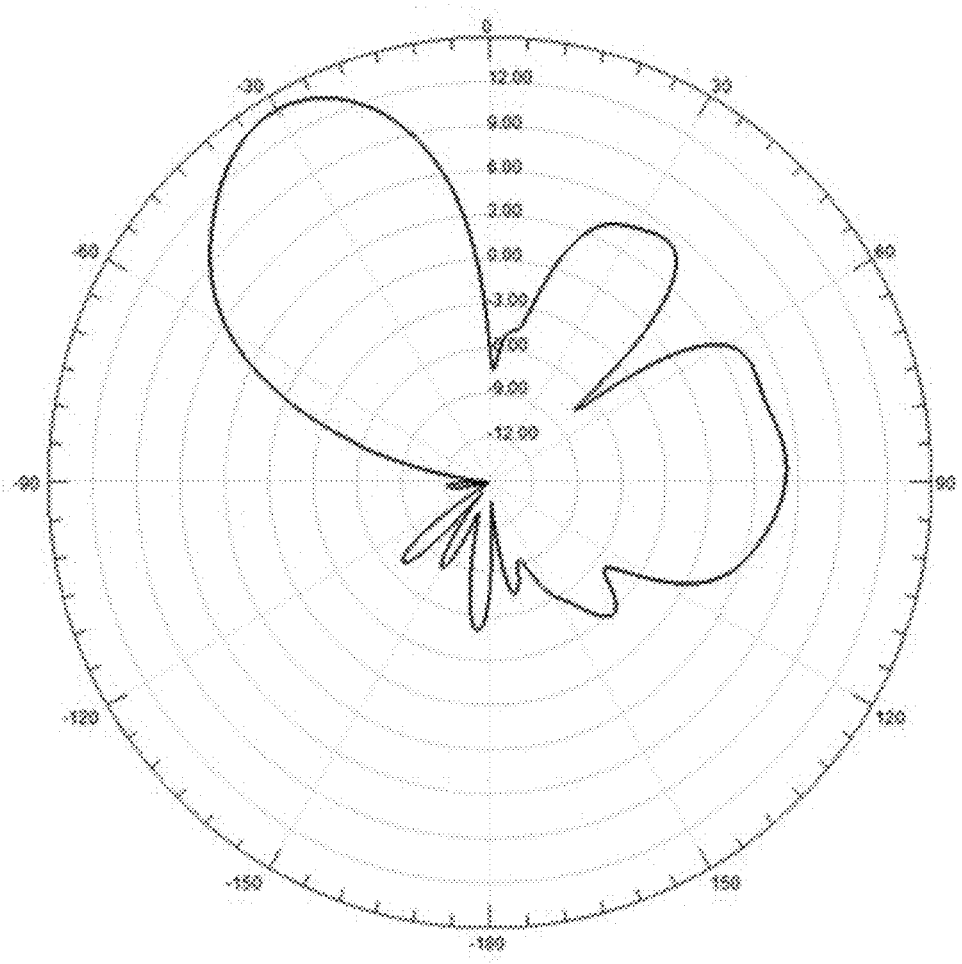
FIG. 20 is a measurement diagram illustrating a radiation pattern of Y-Z plane of the fourth exemplary embodiment of an antenna array.

Referring to FIGS. 18-20, FIG. 18 is a diagram illustrating a fourth exemplary embodiment of an antenna array 3. FIG. 19 is a measurement diagram illustrating a radiation pattern of X-Z plane of the fourth exemplary embodiment of the antenna array 3. FIG. 20 is a measurement diagram illustrating a radiation pattern of Y-Z plane of the fourth exemplary embodiment of the antenna array 3. In the exemplary embodiment, the plane of the base board 2 is the X-Y plane. The direction from the plane of the base board 2 to the radiator 10 is the direction of a positive Z axis. As shown in FIG. 18, the antenna array 3 also comprises nine antennas A1-A9. All of the antennas A1-A9 have the same structure of above antenna 1. The antennas A1-A9 are arranged in a form of 3×3 array. In the exemplary embodiment. Each radiator of the antennas A1-A9 is parallel to the base board 2. Antennas A1-A3 are placed in a first row. Antennas A4-A6 are placed in a second row. Antenna A7-A9 are placed in a third row. The antennas A1, A4, A7 respectively receive signals in which phases are delayed 90 degrees. The antennas A2, A5, A8 respectively receive signals in which phases are 0 degree. The antennas A3, A6, A9 respectively receive signals in which phases are advanced 90 degrees. Thus, beam forming of the antenna array 3 can be controlled. According to FIG. 19 and FIG. 20, powers of beam forming are mainly directed to the negative Y axis. Namely, powers of beam forming are mainly directed to a direction in which angle phi equals to 270 degrees.

In above exemplary embodiments of antenna arrays 3, the antennas A1-A9 are both receiving signals from second feeding portions. In other exemplary embodiment, antennas in an antenna array 3 can be arranged in a form of N×N array. Radiator in every antenna is parallel to the base board 2. The letter N is a positive integer. The letter N represents an antenna quantity in a row or a column. Antennas in the antenna array 3 can receive signals from the first feeding portion. Comparing to a general antenna that only has one radiation pattern, the antenna or the antenna array in the present disclosure not only can radiate signals in a wide signal cover area, but also can radiate signals in a directional signal cover area. Thus, the antenna or the antenna array in the present disclosure can be applied on a ceiling and also on a wall.

Many details are often found in art including other features of the antenna and the antenna array. Therefore, many such details are neither shown nor described. Even though numerous characteristics and advantages of the present disclosure have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will, therefore, be appreciated that the exemplary embodiments described above may be modified within the scope of the claims.

What is claimed is:

1. An antenna electrically coupled to a base board, comprising:

a radiator parallel to the base board to radiate signals;

a first feeding portion, comprising a first end electrically coupled to a central position of the radiator, and a second end receiving a first feeding signal to generate a first radiation pattern;

a second feeding portion, comprising a first end electrically coupled to a first corner of the radiator, and a second end receiving a second signal to generate a second radiation pattern;

a first grounding portion electrically coupled between a second corner of the radiator and a ground plane of the base board;

a second grounding portion electrically coupled between a third corner of the radiator and the ground plane; and a loading portion electrically coupled between a fourth corner of the radiator and a load.

2. The antenna of claim 1, wherein the radiator is square shaped.

3. The antenna of claim 2, wherein the second corner of the radiator and the third corner of the radiator are both aligned in a same diagonal line of the radiator.

4. The antenna of claim 1, wherein the first feeding portion, the second feeding portion, the first grounding portion, the second grounding portion, and the loading portion are strip shaped and wherein the first feeding portion, the second feeding portion, the first grounding portion, the second grounding portion, and the loading portion are perpendicular to the radiator.

5. The antenna of claim 4, wherein the first grounding portion is parallel to the second grounding portion.

6. The antenna of claim 4, wherein the second feeding portion is parallel to the loading portion.

7. The antenna of claim 1, wherein the second feeding portion is electrically coupled to a load when the first radiation pattern are generated, and the first feeding portion is electrically coupled to a load when the second radiation pattern is generated.

8. The antenna of claim 1, wherein when an angle phi equals to 0 degree, a half-power angle of the first radiation pattern is a first range and a second range, the first range is from a first angle to a second angle and the second range is from a third angle to a fourth angle; wherein the half-power angle of the second radiation pattern is a third range, the third range is from the second angle to the third angle; wherein the first angle is smaller than the second angle, the second angle is smaller than the third angle, and the third angle is smaller than the fourth angle.

9. The antenna of claim 1, wherein a range from the first angle to the second angle is larger than 150 degrees.

10. An antenna array comprising:

a plurality of antennas arranged in a form of N×N array, wherein the letter N is a positive integer, the letter N represents an antenna quantity in a row or a column, each antenna of the plurality of antennas is electrically coupled to a base board comprising:

a radiator parallel to the base board to radiate signals;

a first feeding portion, comprising a first end electrically coupled to a central position of the radiator, and a second end receiving a first feeding signal to generate a first radiation pattern;

a second feeding portion, comprising a first end electrically coupled to a first corner of the radiator, and a second end receiving a second signal to generate a second radiation pattern;

a first grounding portion electrically coupled between a second corner of the radiator and a ground plane of the base board;

a second grounding portion electrically coupled between a third corner of the radiator and the ground plane; and a loading portion electrically coupled between a fourth corner of the radiator and a load.

11. The antenna array of claim 10, wherein the radiator is square shaped.

12. The antenna array of claim 11, wherein the second corner of the radiator and the third corner of the radiator are both aligned in a diagonal line of the radiator.

13. The antenna array of claim 10, wherein the first feeding portion, the second feeding portion, the first grounding portion, the second grounding portion and the loading portion are strip shaped; and wherein the first feeding portion, the second feeding portion, the first grounding portion, the second grounding portion and the loading portion are perpendicular to the radiator.

14. The antenna array of claim 13, wherein the first grounding portion is parallel to the second grounding portion.

15. The antenna array of claim 13, wherein the second feeding portion is parallel to the loading portion.

16. The antenna array of claim 10, wherein the second feeding portion is electrically coupled to a load when the first radiation pattern are generated, and the first feeding portion is electrically coupled to a load when the second radiation pattern is generated.

17. The antenna array of claim 10, wherein when an angle phi equals to 0 degree, a half-power angle of the first radiation pattern is a first range and a second range, the first range is from a first angle to a second angle and the second range is from a third angle to a fourth angle; wherein the half-power angle of the second radiation pattern is a third range, the third range is from the second angle to the third angle; wherein the first angle is smaller than the second angle, the second angle is smaller than the third angle, and the third angle is smaller than the fourth angle.

18. The antenna array of claim 10, wherein a range from the first angle to the second angle is larger than 150 degrees.

* * * * *